US011679951B2

(12) United States Patent
Viola et al.

(10) Patent No.: US 11,679,951 B2
(45) Date of Patent: Jun. 20, 2023

(54) UNWINDER FOR WEB MATERIAL AND METHOD FOR CONTROLLING THE UNWINDING OF WEB MATERIAL

(71) Applicant: M.D. VIOLA MACCHINE S.R.L., Valle Salimbene (IT)

(72) Inventors: Marco Viola, Valle Salimbene (IT); Davide Viola, Valle Salimbene (IT); Andrea Viola, Valle Salimbene (IT)

(73) Assignee: M.D. VIOLA MACCHINE S.R.L., Valle Salimbene (IT)

( * ) Notice: Subject to any disclaimer, the term of this patent is extended or adjusted under 35 U.S.C. 154(b) by 354 days.

(21) Appl. No.: 17/253,392

(22) PCT Filed: Jun. 12, 2019

(86) PCT No.: PCT/IB2019/054911

§ 371 (c)(1),
(2) Date: Dec. 17, 2020

(87) PCT Pub. No.: WO2019/243956

PCT Pub. Date: Dec. 26, 2019

(65) Prior Publication Data

US 2021/0261371 A1 Aug. 26, 2021

(30) Foreign Application Priority Data

Jun. 21, 2018 (IT) ..... 102018000006551

(51) Int. Cl.
*B65H 19/14* (2006.01)
*B65H 20/34* (2006.01)
*B65H 21/00* (2006.01)

(52) U.S. Cl.
CPC ..... *B65H 19/14* (2013.01); *B65H 20/34* (2013.01); *B65H 21/00* (2013.01);
(Continued)

(58) Field of Classification Search
CPC ..... B65H 19/14; B65H 20/34; B65H 21/00
See application file for complete search history.

(56) References Cited

U.S. PATENT DOCUMENTS 3,669,375 A * 6/1972 Bruton ..... D06B 17/06 242/421.7
4,793,564 A * 12/1988 Hank ..... B65H 19/14 226/118.2

(Continued)

FOREIGN PATENT DOCUMENTS

EP 3231750 A1 10/2017
WO 2015/019222 A1 2/2015

OTHER PUBLICATIONS

Oct. 2, 2019 Search Report issued in International Patent Application No. PCT/IB2019/054911.

(Continued)

*Primary Examiner* — Sang K Kim
(74) *Attorney, Agent, or Firm* — Oliff PLC

(57) ABSTRACT

An unwinder for web material includes: a first and second reel holder, a dynamic storage device, a junction device arranged between the first or second reel holder and the dynamic storage device and configured to join an end portion of web material running out on the first reel to an initial portion of web material of the second reel, an actuator configured to pull the web material. The dynamic storage device includes: a plurality of first return rollers, a carriage mounted on a guide and free to move along the guide approaching or moving away from the first return rollers, a plurality of second return rollers mounted idly on the carriage. The return rollers define a zigzag path for the web material. The dynamic storage device includes a plurality of motorized shafts and each first return roller is mounted by means of two rolling bearings on a respective motorized shaft.

10 Claims, 8 Drawing Sheets

(52) U.S. Cl.
CPC ..... *B65H 2408/2171* (2013.01); *B65H 2408/2173* (2013.01); *B65H 2701/1924* (2013.01); *B65H 2801/57* (2013.01)

(56) References Cited

U.S. PATENT DOCUMENTS

| | | | | | |
|---|---|---|---|---|---|
| 4,856,692 | A * | 8/1989 | Harper | B65H 20/34 | 226/11 |
| 4,915,282 | A * | 4/1990 | Martin | B65H 20/34 | 226/118.3 |
| 5,190,234 | A * | 3/1993 | Ezekiel | B65H 19/1852 | 242/552 |
| 5,582,339 | A * | 12/1996 | Focke | B65H 19/14 | 226/44 |
| 2002/0059013 | A1 | 5/2002 | Rajala et al. | | |
| 2018/0057293 | A1* | 3/2018 | Shigehara | B65H 20/34 | |
| 2018/0079615 | A1* | 3/2018 | Shigehara | B65H 23/1888 | |

OTHER PUBLICATIONS

Oct. 2, 2019 Written Opinion issued in International Patent Application No. PCT/IB2019/054911.

* cited by examiner

FIG.8
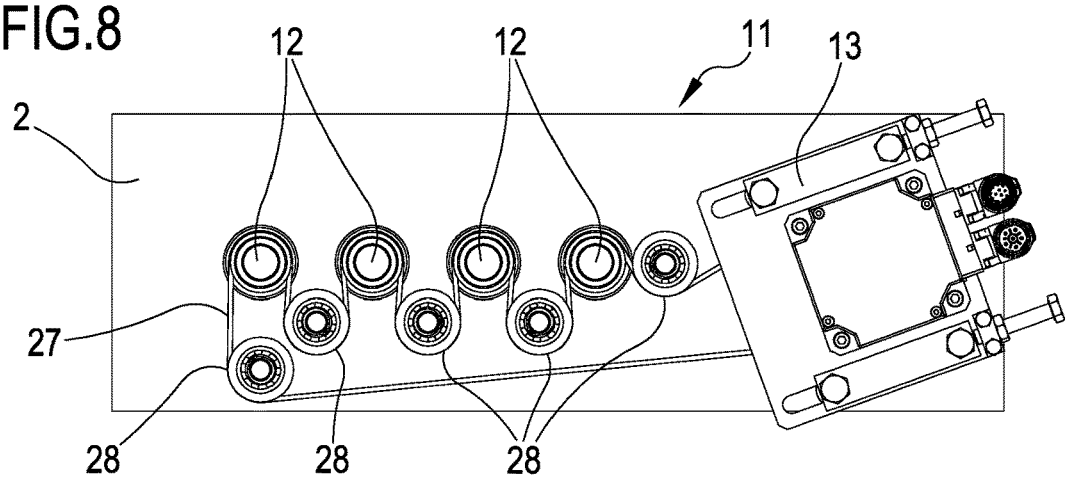
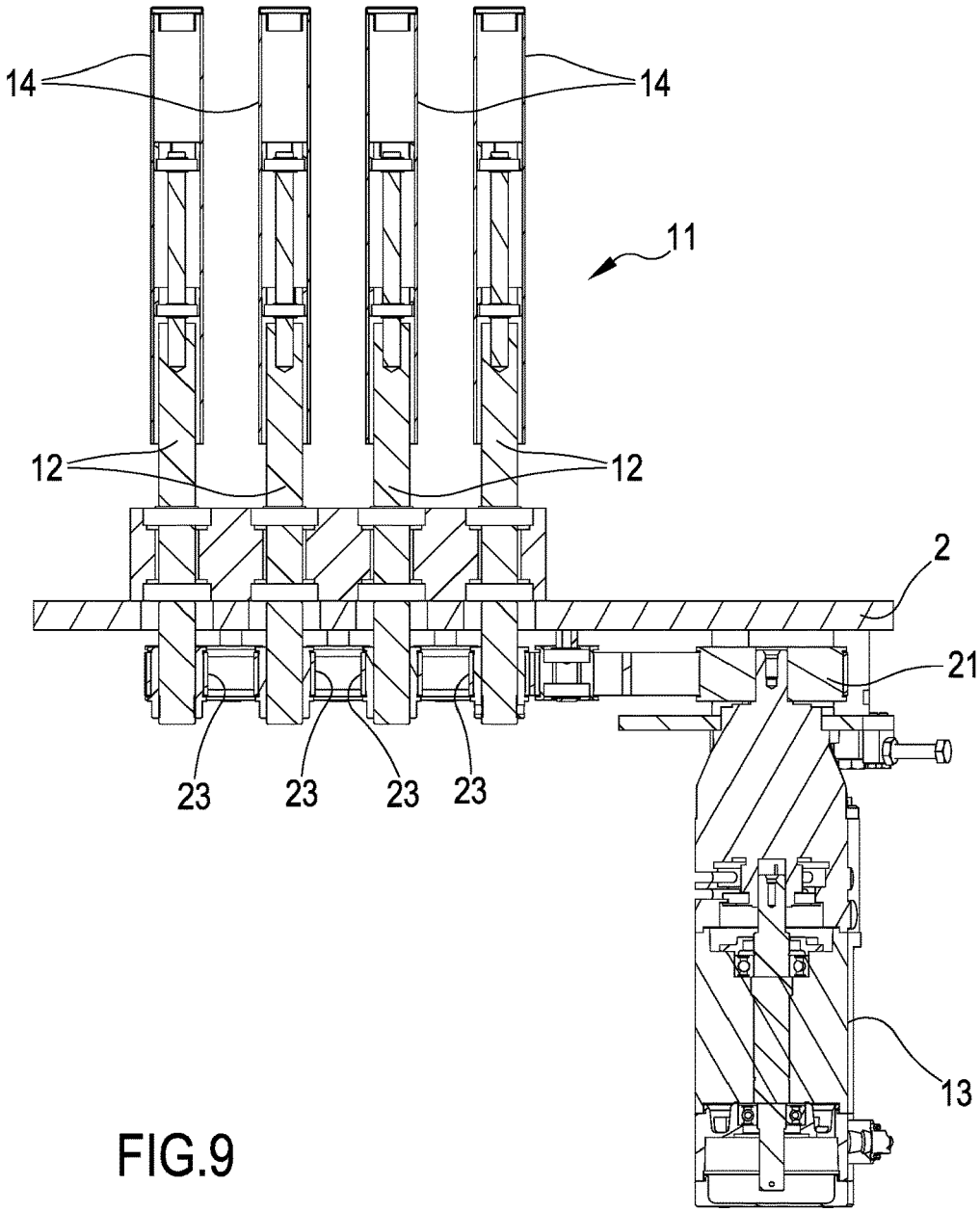
FIG.9

UNWINDER FOR WEB MATERIAL AND METHOD FOR CONTROLLING THE UNWINDING OF WEB MATERIAL

FIELD OF THE INVENTION

The present invention relates to an unwinder for web material and to a method for controlling the unwinding of web material. The present invention also relates to a guide device for web material. Preferably but not exclusively, the present invention is part of the production lines of sanitary articles, such as sanitary napkins, diapers, diapers for adults, panty liners, etc., whose packaging is performed starting from different semi-finished products, among which also web materials wound in reels, such as, for example, polyethylene, non-woven fabric, cellulose wadding (tissue).

PRIOR ART

In the production lines of sanitary items, the web materials are unwound from reels to be subsequently fed to processing stations which provide for example to combine them with other materials, cut them to size, etc.

In order to ensure continuity of production, unwinding devices are known which allow replacing a running-out reel with a new reel ensuring the continuity of the feed and the constancy of the web feeding speed downstream of the unwinder.

For example, an unwinder is known which comprises a first reel holder configured to support a first reel, a second reel holder configured to support a second reel, a junction device, configured to splice an end portion of the material running out on the first reel to an initial portion of the web material of the second reel, and a dynamic storage device located downstream of the junction device and capable of ensuring the constancy of the web feeding speed downstream of the storage device itself. For this purpose, the dynamic storage device comprises a plurality of first idle return rollers mounted on a fixed frame, a carriage mounted on a vertical guide and free to move along the guide approaching or away from the first return rollers, a plurality of second idle return rollers mounted on the carriage. The return rollers define a zigzag path for the web material being unwound from the reel holders. An actuator located downstream of the dynamic storage device is configured to pull the web material. When the speed of the web material unwound from the first reel is decreased and/or canceled to allow junction with an initial end of the web material of the second reel, the traction exerted by the actuator on the web material and the web material on the carriage causes the carriage to rise towards the first return rollers while the web feeding speed downstream of the storage device remains constant. Once the junction has been made, the speed of rotation of the second reel is brought to a value such as to allow the carriage to fall back under the action of its own weight. Also known documents US2002059013 and EP3231750 disclose devices/apparatuses for processing web materials.

OBJECT OF THE INVENTION

The Applicant has observed that at high feeding speeds of the web material and therefore at the high rotation speeds of the idle rollers that guide it, typical of modern production lines, the bearings on which the rollers are mounted generate frictional forces caused inter alia by the lubricating grease contained in the bearings.

The Applicant has observed that the frictional forces are such as to hinder or even prevent the lowering of the carriage under the effect of its own weight and such as to cause the collapse and accumulation of the web material upstream of the storage device. The production line must therefore be stopped and restored.

The Applicant has also observed that it is not possible, to overcome this drawback, to increase the weight of the carriage too much as this would cause the breakage of the web material (which is very often made of paper).

The Applicant has also observed that active systems are known which are able to control the position of the carriage (the carriage is actively moved by means of a motor which regulates the vertical position thereof) to obviate such drawbacks but such systems are complex and difficult to set up because they work with complex algorithms to manage feedback control.

In this context, the Applicant has therefore set itself the goal of proposing an unwinder for web material and a method for controlling the unwinding of web material which allow first of all performing the reel change at high speeds and without drawbacks.

The Applicant, more generally, has set itself the goal of proposing an unwinder for web material and a method for controlling the unwinding of web material which allows controlling the tension of the web material so that such a material does not break nor does it collapse along its feeding path.

The Applicant has also set itself the goal of proposing a device for guiding the web material, which can be combined with the unwinder but also with other portions of an apparatus for the production of articles, preferably sanitary, capable of controlling the tension of the material and of ensuring the correct functioning of the apparatus.

The Applicant has also set itself the objective of proposing an unwinder for web material and a guide device for the web material which are structurally simple, cost-effective and easy to maintain.

SUMMARY OF THE INVENTION

The Applicant has found that such goals and further objects can be achieved by providing an unwinder for web material, a method for controlling the unwinding of web material, a guide device for web material and also an apparatus for producing articles, preferably sanitary, according to the present invention, of the type claimed in the appended claims and/or described in the following aspects.

In particular, the guide device according to the invention comprises at least one return roller on which the web material is partially wound, wherein said return roller is rotatably mounted, preferably by means of bearings, on a shaft connected to a motor configured for causing the shaft to rotate about its own main axis and in a direction according to a feeding direction of the web material.

In particular, according to an aspect, the present invention relates to a guide device for a web material, wherein said guide device is arranged along a feeding path of the web material and comprises: a frame; at least one motorized shaft, preferably a plurality of motorized shafts, mounted on the frame; at least one motor coupled to said at least one motorized shaft to rotate it around its own main axis; at least one return roller rotatably coupled to said at least one motorized shaft, preferably by at least one bearing, preferably rolling, and free to rotate on said at least one motorized shaft.

According to an aspect, the present invention relates to an unwinder for a web material comprising a guide device for web material according to one or more of the aspects described herein.

According to an aspect, the present invention relates to an unwinder for web material, comprising:

a reel holder configured to support a reel of web material;

a dynamic storage device comprising:

a fixed frame;

at least one first return roller, preferably a plurality of first return rollers, mounted on the fixed frame;

a carriage mounted on a guide of the fixed frame and free to move along the guide moving towards or away from the first return roller;

at least one second return roller, preferably a plurality of second return rollers, mounted idle on the carriage;

wherein said at least one first return roller and said at least one second return roller define a zigzag path for the web material unwinding from the reel holder;

an actuator located downstream of the dynamic storage device and configured to pull the web material;

wherein the dynamic storage device comprises at least one motorized shaft, preferably a plurality of motorized shafts, mounted on the fixed frame, wherein said at least one first return roller is free to rotate on said at least one motorized shaft or wherein each first return roller is free to rotate on the respective motorized shaft.

According to an aspect, the present invention relates to an unwinder for web material, comprising:

a first reel holder configured to support a first reel of web material;

a second reel holder configured to support a second reel of web material;

a dynamic storage device comprising:

a fixed frame;

at least one first return roller, preferably a plurality of first return rollers, mounted on the fixed frame;

a carriage mounted on a guide of the fixed frame and free to move along the guide moving towards or away from the first return roller;

at least one second return roller, preferably a plurality of second return rollers, mounted idle on the carriage;

wherein said at least one first return roller and said at least one second return roller define a zigzag path for the web material unwinding from the first reel holder or from the second reel holder;

a junction device disposed between the first reel holder or the second reel holder and the dynamic storage device and configured to splice an end portion of the web material running low on the first reel to an initial portion of the web material of the second reel or vice versa;

an actuator located downstream of the dynamic storage device and configured to pull the web material;

wherein the dynamic storage device comprises at least one motorized shaft, preferably a plurality of motorized shafts, mounted on the fixed frame, wherein said at least one first return roller is free to rotate on said at least one motorized shaft or wherein each first return roller is free to rotate on the respective motorized shaft.

According to an aspect, the present invention relates to a method for controlling the unwinding of web material, comprising:

pulling, by means of an actuator, a web material unwound from a reel along a feeding path and through a dynamic storage device located between said reel and said actuator;

wherein, in the dynamic storage device, the web material is arranged to zigzag around at least a first return roller, preferably to a plurality of first return rollers, and around at least a second return roller, preferably to a plurality of second return rollers, mounted idle on a carriage free to move towards or away from the first return roller;

wherein it is also envisaged to rotate, through at least one motor and in a direction consistent with a feed direction of the web material, at least one motorized shaft on which said at least one first return roller is idly mounted.

According to an aspect, the present invention relates to a method for controlling the unwinding of web material, comprising:

pulling, by means of an actuator, a web material unwound from a first reel along a feeding path and in sequence through a junction device and a dynamic storage device located between said first reel and said actuator;

wherein, in the dynamic storage device, the web material is arranged to zigzag around at least a first return roller, preferably to a plurality of first return rollers, and around at least a second return roller, preferably to a plurality of second return rollers, mounted idle on a carriage free to move towards or away from the first return roller;

decreasing a speed of the web material unwound from the first reel in a portion placed at the junction device and splicing an end portion of the web material running low on the first reel to an initial portion of a web material of a second reel maintaining a constant delivery speed of the web material downstream of the dynamic storage device by approaching the carriage to the first return roller caused by the traction exerted by said strip material;

conferring to the web material unwound from the second reel a speed greater than the delivery speed to move away the carriage from the first return roller under the weight of the carriage;

wherein it is also envisaged to rotate, through at least one motor and in a direction consistent with a feed direction of the web material, at least one motorized shaft on which said at least one first return roller is idly mounted.

According to an aspect, the present invention relates to an apparatus for the production of articles, preferably sanitary, starting from a web material, wherein the apparatus has at least one feeding path of at least one web material unwound from at least one reel, wherein the apparatus comprises at least one guide device of web material and/or an unwinder for web material according to one or more of the aspects described herein.

The Applicant has verified that the solution according to the invention allows keeping under control and compensating for the speed variations upstream of the device and/or the tension of the web material in a reliable and simple manner, also due to the self-adaptation to different speed and different materials.

It follows that the solution according to the invention allows reducing machine downtime, failures and drawbacks in general.

In particular, the Applicant has verified that the solution according to the invention allows performing the reel change at high speeds and without drawbacks.

Further aspects of the invention are described below.

In one aspect, at least one bearing is interposed between said at least one motorized shaft and said at least one first return roller to allow the first return roller to rotate with respect to the respective motorized shaft.

In one aspect, the bearing is of the rolling type and contains grease or other lubricating substance.

In one aspect, a linear speed of the web material along the feeding path is between 0 m/min and 500 m/min.

In one aspect, a rotation speed of the first and/or subsequent return rollers is between 0 rpm and 4000 rpm.

In one aspect, a speed of rotation of the motorized shafts is between 0 with the machine stopped and it increases following the unwinding speed of the material up to 4000 rpm, which corresponds to 500 meters per minute on the outside of the rollers 14.

The Applicant has verified that, due to the motorized rotation of the shafts, it is possible, in some operating steps, to contain or cancel the relative speed of the first rollers with respect to the motorized shafts and therefore the relative rotation speed of the bearings, or the speed of the balls/rollers of the bearings and the stresses generated in the lubricating substance. Moreover, due to the motorized/idle rollers 14, it is possible to have during the reel change an acceleration of the rollers 14 from 0 to 4000 rpm with an immediate reaction time. In particular, this allows containing the frictional forces due to the bearings and therefore allow the rapid return of the carriage under the effect of its own weight even at high speeds and without the aid of complex active devices that act in feedback. In this step, a relative rotation speed of the bearings is between 4000 rpm and 0 rpm.

Moreover, due to the motorized/idle rollers, it is possible to have during the reel change an acceleration of the rollers themselves from 0 to 4000 rpm with immediate reaction time, due to the dragging carried out by said motorized shafts on the first bearings positioned at the inlet of the web material.

In one aspect, the motorized shafts are parallel to each other and side by side.

In one aspect, the motorized shafts are in a number of between two and six.

In one aspect, the dynamic storage device or the guide device comprises a motor operatively connected to said at least one motorized shaft.

In one aspect, the dynamic storage device or the guide device comprises a transmission operatively arranged between the motor and said at least one motorized shaft.

In one aspect, the dynamic storage device or the guide device comprises a single motor and a transmission operatively arranged between the single motor and the plurality of motorized shafts.

In one aspect, the dynamic storage device or the guide device comprises a plurality of motors, each coupled to a respective motorized shaft.

In one aspect, the transmission is belt and/or gear.

In one aspect, the motorized shafts are all rotated at the same speed of rotation.

In one aspect, the motorized shafts are rotated at different speeds of rotation.

In one aspect, a transmission ratio between the motor and the motorized shafts is the same for all the motorized shafts.

In one aspect, transmission ratios between the motor and the motorized shafts are different for each motorized shaft or for groups of motorized shafts.

The rotation speeds can be set according to the position of the motorized shafts along the feeding path.

In one aspect, the actuator comprises a traction roller.

In one aspect, the traction roller is located immediately downstream of said at least one first return roller.

In one aspect, the actuator comprises a counter-roller combined with the traction roller. The web material passes between the traction roller and the counter-roller.

In one aspect, the actuator comprises a motor dedicated to said traction roller.

In one aspect, the same motor is operatively coupled to the traction roller to rotate the traction roller and to said at least one motorized shaft.

A single motor is therefore used to directly drag the web material and move the motorized shafts.

In one aspect, a transmission ratio between the traction roller and said at least one motorized shaft is such that a peripheral speed of the traction roller is equal to a peripheral speed of said at least one first return roller when said at least one first return roller rotates integral with the respective driven shaft.

In one aspect, a diameter of the traction roller is greater than a diameter of said at least one first return roller.

In one aspect, a transmission ratio between the traction roller and said at least one motorized shaft is less than one.

In one aspect, the carriage is mounted below said at least one first return roller.

In one aspect, the guide is vertical.

In one aspect, the guide is inclined.

In one aspect, the unwinder comprises a vertical wall, wherein the first reel holder, the second reel holder, the junction device, the carriage with said at least one second return roller, said at least one first return roller, the traction roller are mounted on one side of the vertical wall.

In one aspect, axes of rotation of the first reel holder, of the second reel holder, of said at least one second return roller, of said at least one first return roller, of the traction roller are parallel to each other.

In one aspect, the junction device comprises a cutter for cutting the web material running out of the first reel downstream of a junction with the web material of the second reel or vice versa.

Further features and advantages will become more apparent from the detailed description of a preferred but non-exclusive embodiment of an unwinder for web material and of embodiments of a guide device of web material according to the present invention.

BRIEF DESCRIPTION OF THE DRAWINGS

Such description is given hereinafter with reference to the accompanying drawings, provided only for illustrative and, therefore, non-limiting purposes, in which:

FIG. 8 is a rear view of the variant of FIG. 6 or 7;

FIG. 9 is sectional view of the variant of FIG. 6, 7 or 8.

DETAILED DESCRIPTION OF PREFERRED EMBODIMENTS OF THE INVENTION

Figure 1:
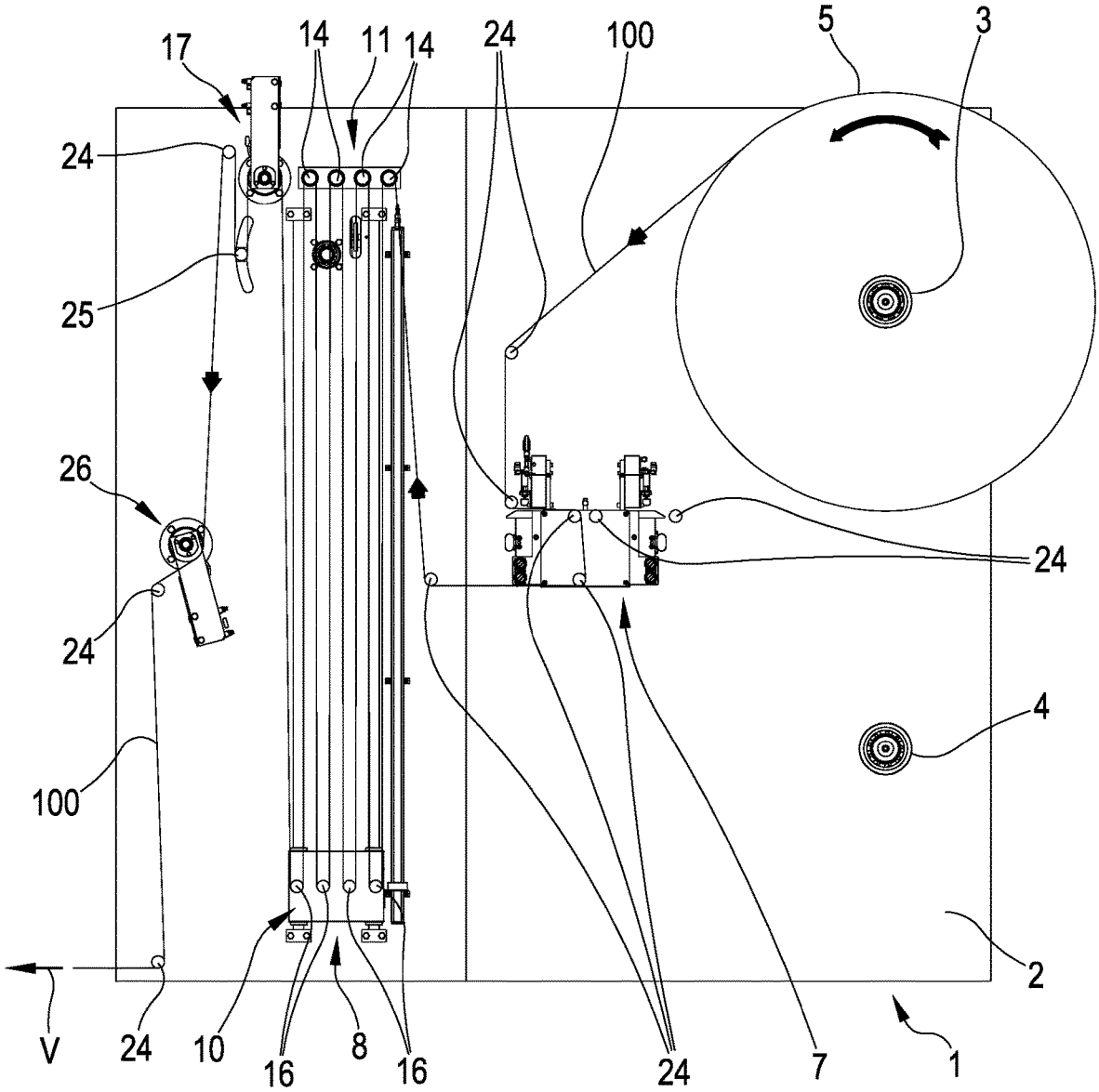
FIG. 1 shows a side elevation view of an unwinder according to the present invention in a first operating configuration.

With reference to the accompanying figures, reference numeral 1 indicates as a whole an unwinder for web material 100 according to the present invention.

The illustrated unwinder 1 is part of an apparatus for the production of sanitary articles, such as sanitary napkins, diapers, diapers for adults, panty liners. In the apparatus 1, the packaging of the aforementioned articles is carried out starting from different semi-finished products, including web materials wound on a reel, such as for example polyethylene, non-woven fabric, cellulose wadding (tissue).

The unwinder 1 comprises a fixed support frame 2, shown in the figures as a vertical wall, on one side of which a first reel holder 3 and a second reel holder 4 are mounted, each configured to support a first reel 5 of web material 100 and a second reel 6 of web material 100. The first reel holder 3 and the second reel holder 4 rotate around respective axes moved by motors not shown and located behind the vertical wall.

On the vertical wall, a per se known junction device 7 is installed, only schematically illustrated and not described in detail herein. The junction device 7 comprises means for mutually joining portions of web material 100 and a cutter configured to cut the web material 100. The junction device 7 further comprises rollers configured to guide and/or hold the web materials during joining and cutting. The unwinder 1 comprises a dynamic storage device 8 comprising a vertical guide 9 defined by a pair of vertical bars (better visible in FIG. 3) on which a carriage 10 is slidably engaged. In alternative embodiments, not shown, the guide may be inclined instead of being vertical.

A guide device 11 of web material 100 is mounted on the fixed frame 2 and is located at an upper end of the vertical guide 9. The guide device 11 comprises four motorized shafts 12 which project from the fixed frame 2 and are mutually parallel and spaced apart. The motorized shafts 12 are rotatably coupled to the fixed frame 2 and are connected to a motor 13 configured to rotate them around their main axes. As shown in FIGS. 4-9, the motor 13 is mounted on the fixed frame 2 on the opposite side with respect to the motorized shafts 12. Each of the motorized shafts 12 carries a respective first return roller 14. The first return roller 14 is mounted on the motorized shaft 12 by means of a pair of rolling bearings 15 and is free to rotate on the motorized shaft 12 except for the friction generated by the bearings 15, i.e. by the lubricating grease thereof, which becomes relevant only at high relative speeds (typically higher than 600 rpm) between the motorized shaft 12 and the respective first return roller 14.

Figure 2:
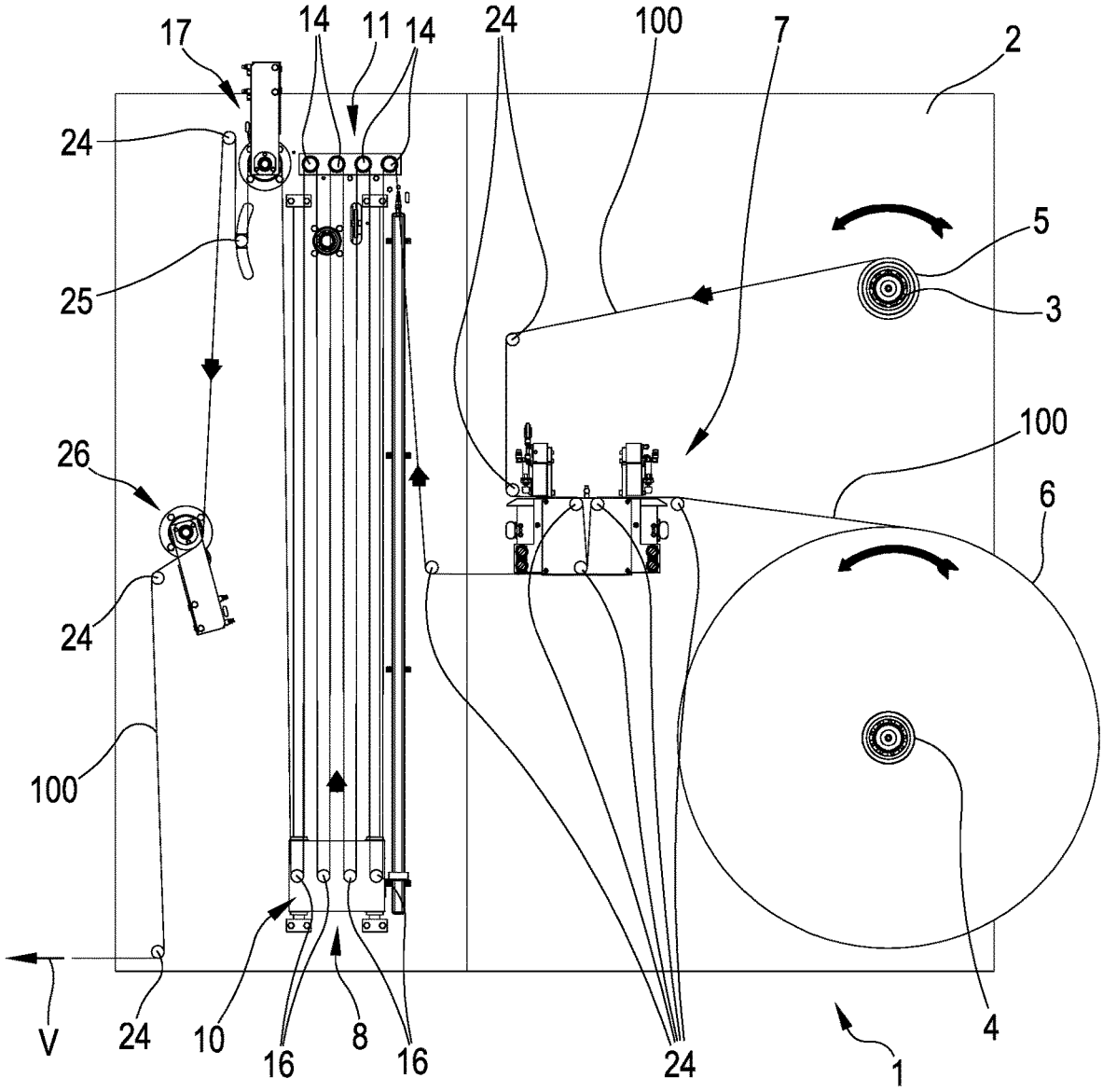
FIG. 2 shows the unwinder of FIG. 1 in a second operating configuration.
Figure 3:
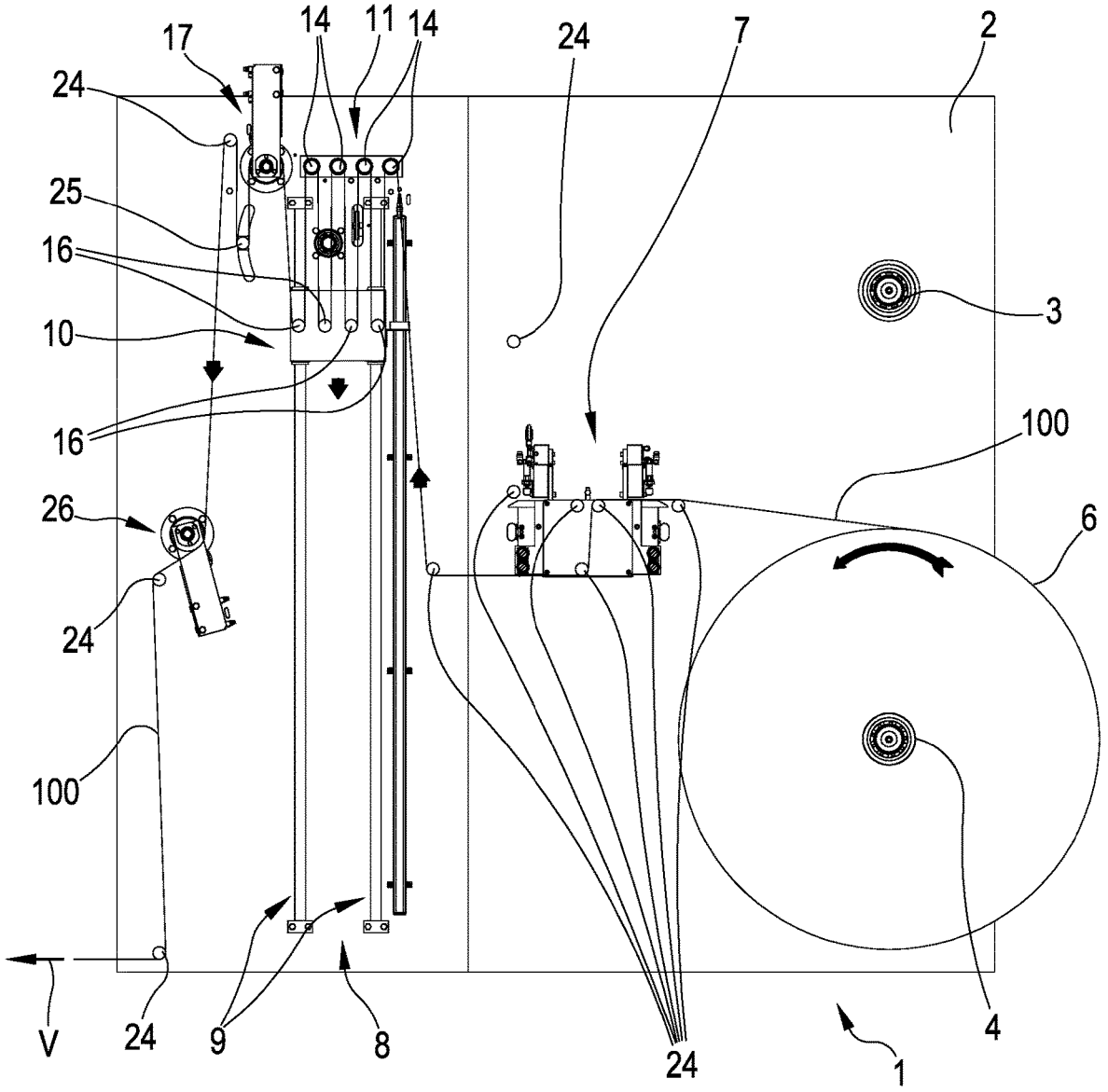
FIG. 3 shows the unwinder of FIG. 1 or 2 in a third operating configuration.

Four second return rollers 16 are idly mounted on the carriage 10 and are free to rotate about respective axes. The first and second return rollers 14, 16 are parallel to each other and define a zigzag path for the web material 100 being unwound from the first reel holder 3 or from the second reel holder 4 (FIGS. 1, 2 and 3).

The web material 100 coming from the junction device 7 is partially wound on one of the first return rollers 14, then on one of the second return rollers 15, again on one of the first return rollers 14 and so on.

Figure 4:
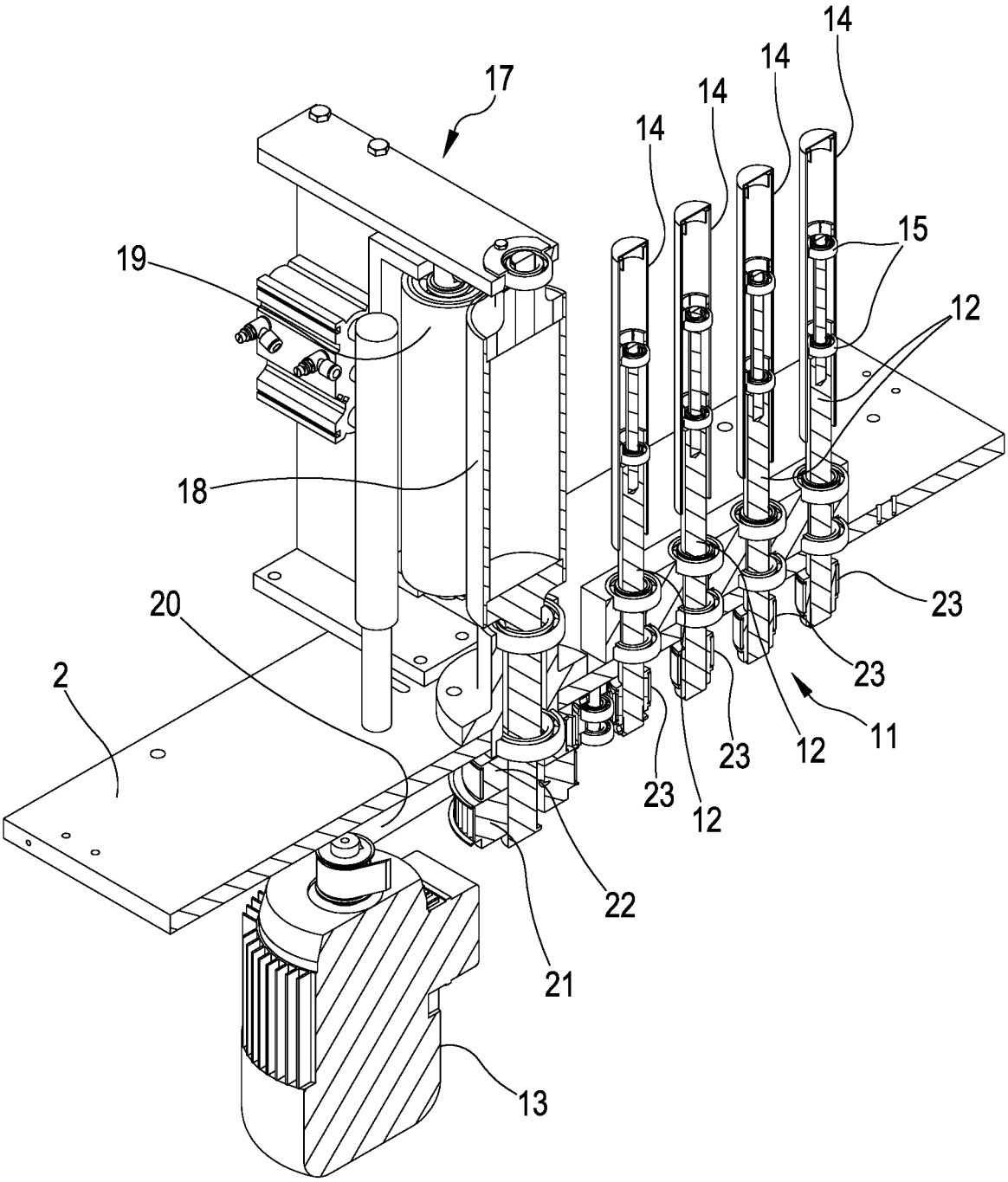
FIG. 4 is a sectional perspective view of a device of the unwinder of FIG. 1, 2 or 3.
Figure 5:
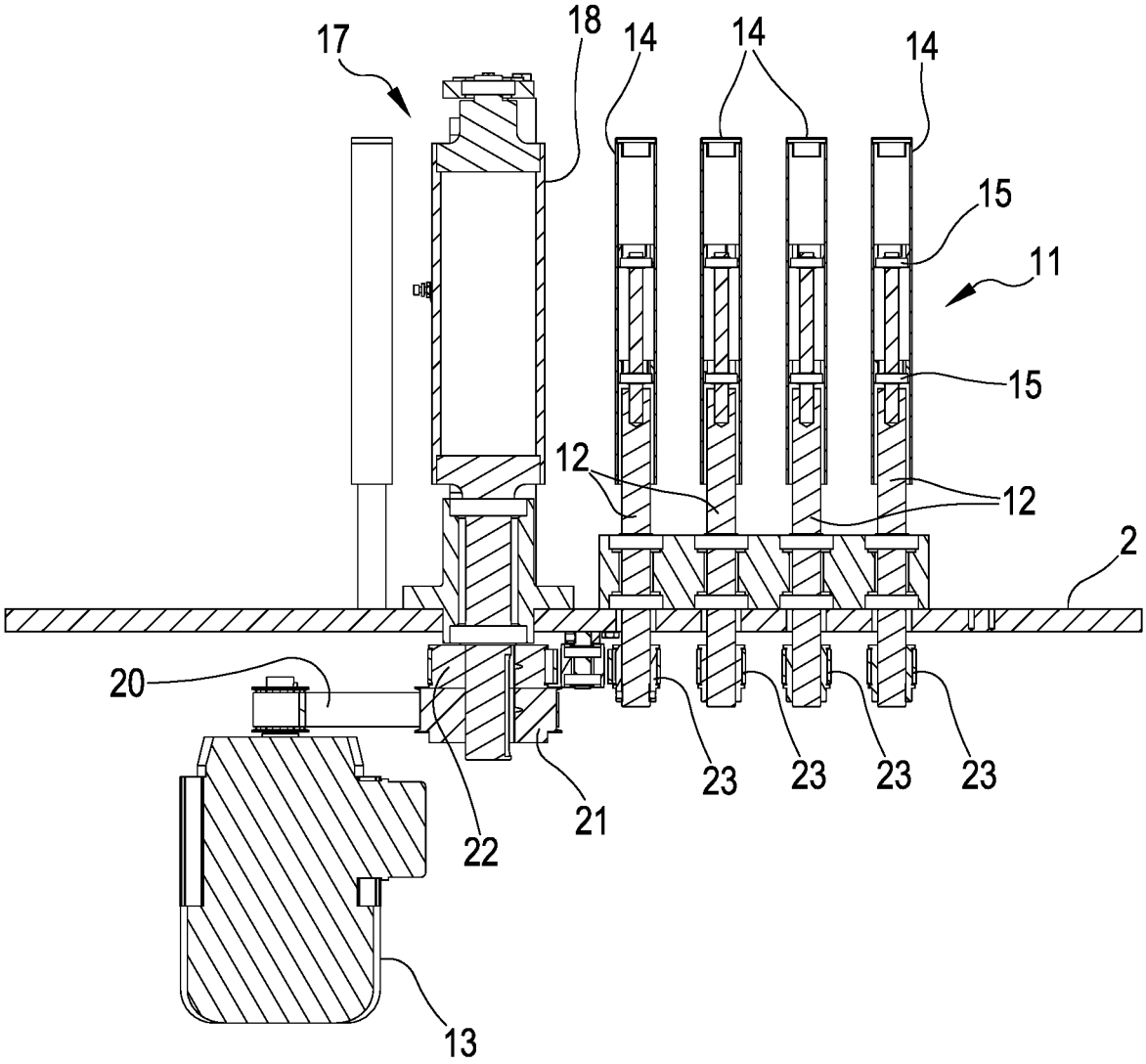
FIG. 5 is a sectional view of the device of FIG. 4.

An actuator 17 is mounted on the fixed frame 2 just downstream of the dynamic storage device 8. In the illustrated embodiment, the actuator 17 is positioned next to the guide device 11 and comprises a traction roller 18 and a counter-roller 19 which rotate around respective axes parallel to the axes of the first return rollers 14, and of the second return rollers 15 (FIGS. 4 and 5).

A shaft integral with the traction roller 18 is connected by means of a belt 20 and a pulley 21 to the same motor 13 of the guide device 11. The shaft integral with the traction roller 18 is also connected by means of a further pulley 22 and a further belt, not shown in FIGS. 5 and 6, with pulleys 23 integral with the motorized shafts 12. Such a transmission is located on the same side of the motor 13. In the illustrated embodiment, the pulleys 23 are equal to each other and therefore the motorized shafts 12 are made to rotate all at the same speed of rotation.

A transmission ratio between the traction roller 18 and the motorized shafts 12 is such that a peripheral speed of the traction roller 18 is equal to a peripheral speed of the first return rollers 14 if and when the first return rollers 14 rotate integrally with the respective motorized shafts 12.

In the illustrated embodiment, a diameter of the traction roller 18 is greater than the diameter of the first return rollers 14, so that a transmission ratio between the traction roller 18 and said at least one motorized shaft 12 is less than one.

Downstream of the actuator 17, there are further return elements 24 and/or tensioners 25 and/or actuators 26 of a known type and not further described. Also upstream of the dynamic storage device 8, further return elements 24 are present between the reel holders 3, 4 and the junction device 7 and/or between the junction device 7 and the dynamic storage device 8. The junction device 7 itself comprises return elements 24.

As can be seen in FIG. 1, the web material 100 which unwinds from the first reel is guided along a feeding path which passes through the junction device 7 and then reaches a first return roller 14 of the guide device 11. The web material 100 winds partially above the first return roller 14 and then descends to a second return roller 16 placed on the carriage 10 to then ascend towards the guide device 11 and pass on a subsequent first return roller 14 and back down and so on.

At the end of the zigzag path, the web material 100 rises from the last second return roller 16 placed on the carriage 8 and passes between the traction roller 18 and the counter-roller 19 to then pass on the further return elements 24 and/or tensioners 25 and/or actuators 26 located further downstream and leave the unwinder 1.

The traction roller 18 pulls the web material 100 while the first reel 5 is actively rotated by the respective motor. For example, the traction roller 18 rotates with an angular speed of 2000 rpm. The carriage 8 lies in a lowered position and at the maximum distance from the guide device 11. The web material 100 exits from the unwinder 1 with a constant delivery speed "V", for example of 500 m/min. This speed substantially corresponds to the linear speed of the web material 100 along the feed path. The motor 13, in addition to moving the traction roller 18, keeps the motorized shafts 12 of the first return rollers 14 in rotation. When fully operational, a speed of rotation of the motorized shafts 12 is, for example, 4000 rpm. Under these conditions, the relative speed of the rollers 14 with respect to the motorized shafts 12 and therefore the relative rotation speed of the bearings 15 is zero or very low, for example between 0 rpm and 100 rpm. This makes it possible to contain the frictional forces generated inside the bearings 15.

Moreover, it must be considered that, during the reel changes and during the rising of the carriage 10 which carries the return rollers 16, there is a substantial difference in the rotation speed of both the second idle return rollers 16 and the first idle/motorized return rollers 14. In particular, the first and second return rollers 14, 16 positioned towards the traction roller 18 will have a peripheral speed almost equal to the speed of the traction roller 18 while the first and second return rollers 14, 16 positioned at the inlet of the web material 100 will reach the same speed as the reel during deceleration to carry out the change up to zero speed. Since the first return rollers 14 are free to rotate on the respective motorized shafts 12, unless of the negligible friction in these conditions of the bearings 15, they are able to compensate for all speed fluctuations and/or stretching of the web material 100. Furthermore, once the change with the new reel has been made, it is necessary that the first and second rollers 14, 16 positioned at the inlet of the web material 100 can accelerate in the shortest possible time from zero to reach the new speed of the web material 100 in order to continue with the normal performance of the material at a constant speed on all the first and second rollers 14, 16.

This is possible due to the motorized shaft which, through the bearings and the grease it contains, facilitates the acceleration of the rollers up to the desired speed.

More in detail, before the first reel 5 runs out, a second reel 6 is installed on the second reel holder 4 and an initial end of the web material 100 of the second reel 6 is, for example, manually positioned in the junction device 7.

When the first reel 5 is about to run out (FIG. 2), a control system for the unwinder 1 or the apparatus provides to reduce or cancel the rotation speed of the first reel holder 3 and controls the junction device to determine the junction of an initial portion of the web material 100 of the second reel 6 with an end portion of the web material 100 running out on the first reel 5.

Meanwhile, the motor 15 maintains the rotation speed of the traction roller 18 constant in order to keep the delivery speed "V" unchanged. In this step, the first and second return rollers 14, and 16 positioned at the inlet of the web material 100 will reach the same speed as the reel during the slowing down to effect the change up to zero speed.

Furthermore, the tension generated in the web material 100 located in the dynamic storage device 8 pulls the carriage 10 upwardly towards the first return rollers 14. Just after the junction and the reel change, the carriage 10 is located at the top (FIG. 3) and must be lowered for the subsequent reel change.

For this purpose, the motor of the second reel holder 4 is controlled to rotate at a speed such as to give the web material placed upstream of the dynamic storage device 8 a linear speed greater than the delivery speed "V" to cause the carriage 10 to move away from the first return rollers 14 under the action of the weight of the carriage 10.

In this step, the rotation of the motorized shafts 12 in a direction according to a feeding direction of the web material 100 and to a direction of rotation of the first return rollers 14 carried by the web material 100 allows the first and second rollers 14, 16 positioned at the inlet of the web material 100 to accelerate in the shortest possible time from zero to the speed of the web material 100.

Moreover, the rotation of the motorized shafts 12 reduces the relative speed of the rollers 14 with respect to the motorized shafts 12 and contains the friction forces inside the bearings 15 which therefore do not oppose the descent of the carriage 10.

The guide device 11 described above and illustrated in FIGS. 4 and 5, as well as in the unwinder 1, may also be used in other points of the apparatus for the production of sanitary articles along the feeding path of the web material 100 with the purpose, for example, of controlling the tension of the web material 100.

Figure 6:
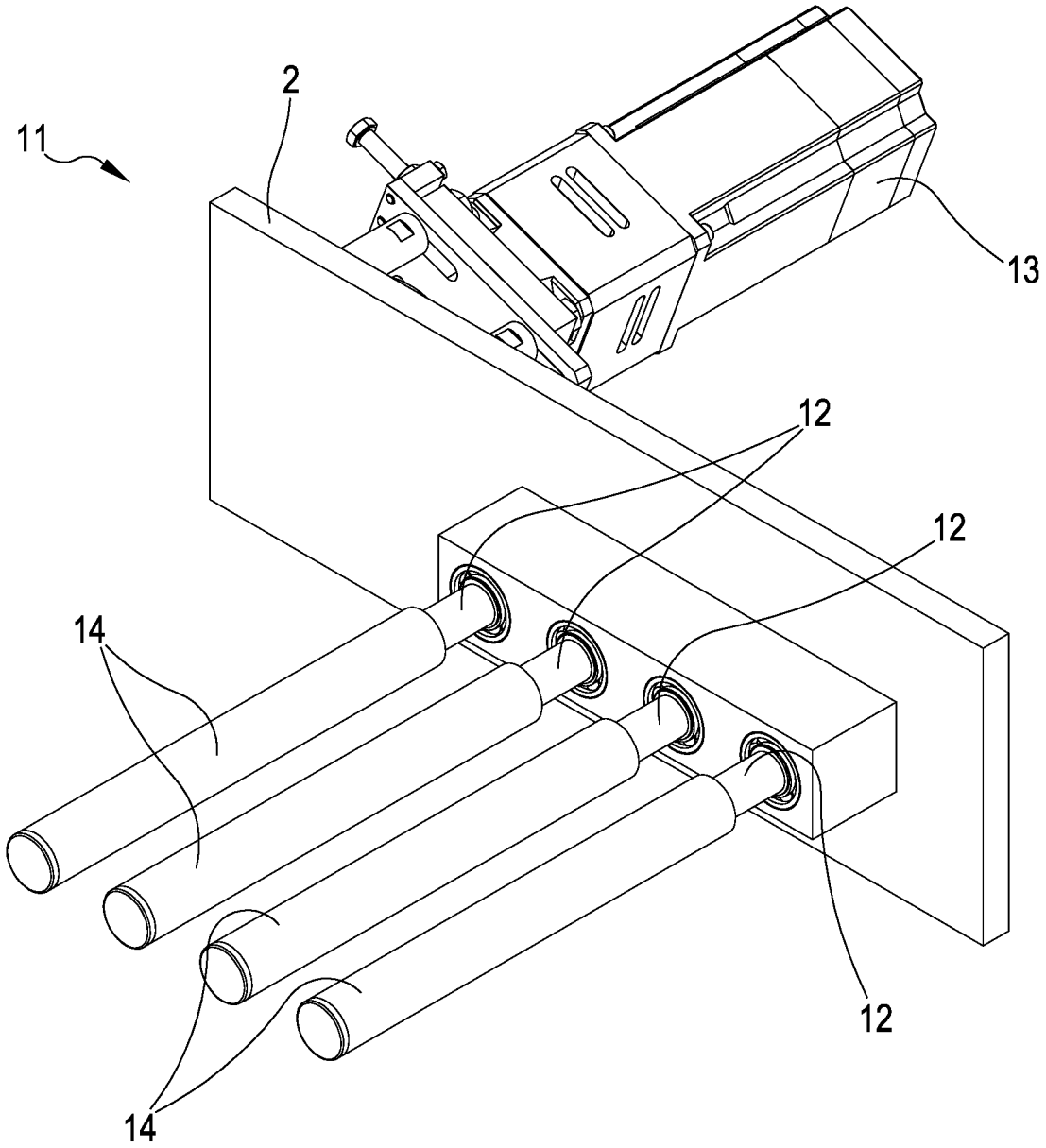
FIG. 6 is a front perspective view of a variant of the device of FIGS. 4 and 5.
Figure 7:
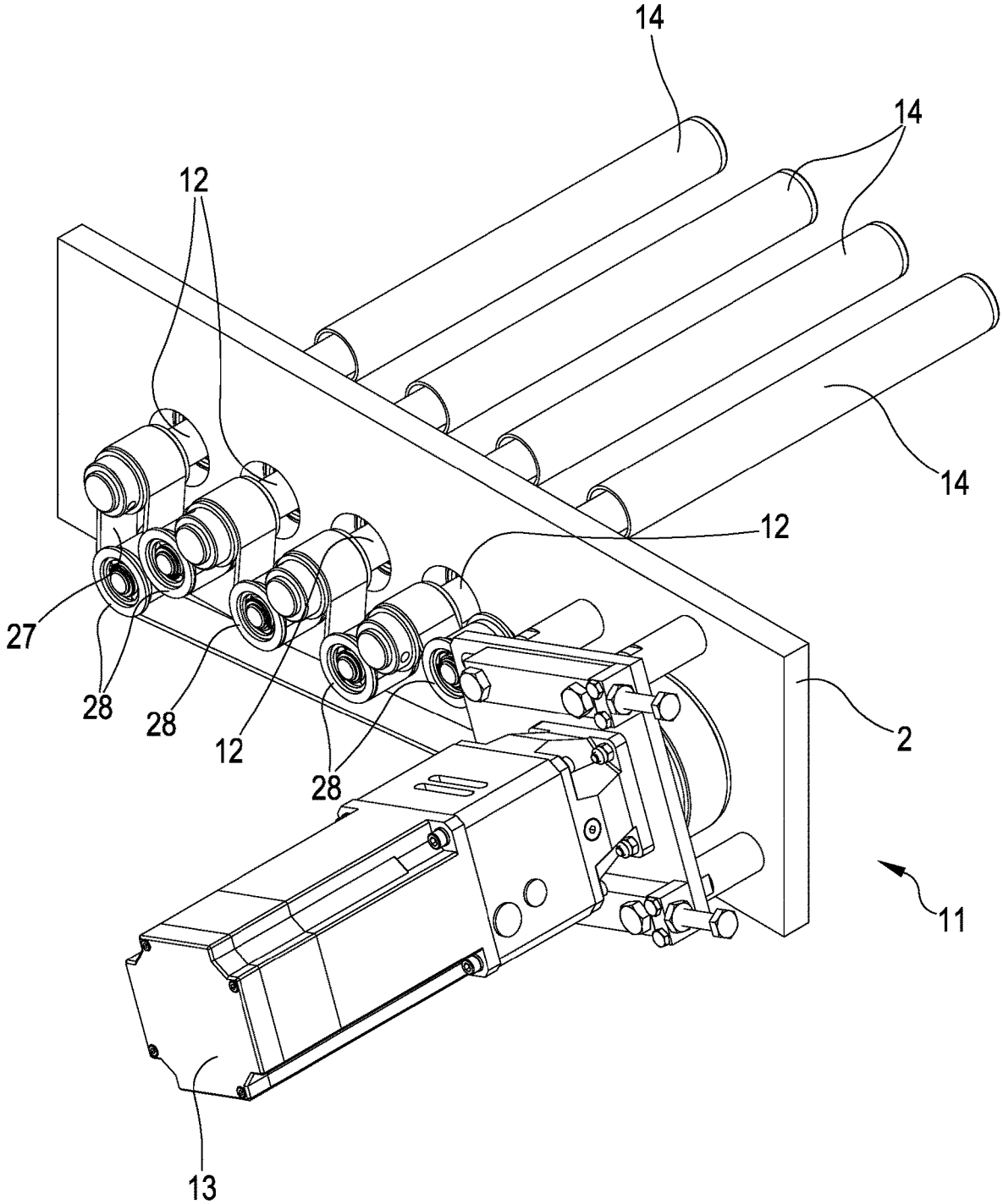
FIG. 7 shows a rear perspective view of the variant of FIG. 6.

FIGS. 6, 7 and 8 illustrate a variant of the device 11 in which the motor 13 is dedicated only to moving the motorized shafts 12. In this variant, a belt 27 winds around the pulley 21 of the motor 13 and on each of the pulleys 23 of the motorized shafts 12. Such a device 11 further comprises further pulleys 28 configured to guide and/or hold the belt 27 in tension.

In other embodiments, not shown, the guide device 11 comprises a plurality of motors, each coupled to a respective motorized shaft 12 so as, for example, to make them rotate with different rotation speeds. The rotation speeds can be set according to the position of the motorized shafts 12 along the feeding path.

In other embodiments, not shown, the motor 13 is only one but transmission ratios between the motor and the motorized shafts 12 are different for each motorized shaft 12 or for groups of motorized shafts 12.

In other embodiments, not shown, instead of the transmission belt 20 or 27, gears may be used.

The invention claimed is:

1. An unwinder for web material, comprising:

a first reel holder configured to support a first reel of web material;

a second reel holder configured to support a second reel of web material;

a dynamic storage device comprising:

a fixed frame;

at least one first return roller mounted on the fixed frame;

a carriage mounted on a guide of the fixed frame and free to move along the guide moving towards or away from the first return roller;

at least one second return roller mounted idle on the carriage;

wherein said at least one first return roller and said at least one second return roller define a zigzag path for the web material unwinding from the first reel holder or from the second reel holder;

a junction device disposed between the first reel holder or the second reel holder and the dynamic storage device and configured to splice an end portion of the web material running low on the first reel to an initial portion of the web material of the second reel or vice versa;

an actuator located downstream of the dynamic storage device and configured to pull the web material;

wherein the dynamic storage device comprises at least one motorized shaft mounted on the fixed frame, wherein said at least one first return roller is free to rotate on said at least one motorized shaft or wherein each first return roller is free to rotate on the respective motorized shaft.

2. The unwinder according to claim 1, wherein at least one bearing is interposed between said at least one motorized shaft and said at least one first return roller to allow the first return roller to rotate with respect to the respective motorized shaft.

3. The unwinder according to claim 1, wherein the dynamic storage device comprises a motor and a transmission operatively arranged between the motor and said at least one motorized shaft.

4. The unwinder according to claim 3, wherein the actuator comprises a traction roller and said motor is operatively coupled to the traction roller to rotate the traction roller and to said at least one motorized shaft.

5. The unwinder according to claim 4, wherein a transmission ratio between the traction roller and said at least one motorized shaft is such that a peripheral speed of the traction roller is equal to a peripheral speed of said at least one first return roller when said at least one first return roller rotates integral with the respective driven shaft.

6. The unwinder according to claim 1, wherein the dynamic storage device comprises a single motor and a transmission operatively arranged between the single motor and the plurality of motorized shafts.

7. The unwinder according to claim 1, wherein the dynamic storage device comprises a plurality of motors, each coupled to a respective motorized shaft.

8. The unwinder according to claim 1, wherein the carriage is mounted below said at least one first return roller and the guide is vertical or inclined.

9. A method for controlling the unwinding of web material, comprising:

pulling, by an actuator, a web material unwound from a first reel along a feeding path and in sequence through a junction device and a dynamic storage device located between said first reel and said actuator;

wherein, in the dynamic storage device, the web material is arranged to zigzag around at least a first return roller and around at least a second return roller, mounted idle on a carriage free to move towards or away from the first return roller;

decreasing a speed of the web material unwound from the first reel in a portion placed at the junction device and splicing an end portion of the web material running low on the first reel to an initial portion of a web material of a second reel maintaining a constant delivery speed of the web material downstream of the dynamic storage device by approaching the carriage to the first return roller caused by the traction exerted by said strip material;

conferring to the web material unwound from the second reel a speed greater than the delivery speed to move away the carriage from the first return roller under the weight of the carriage; and rotating, through at least one motor and in a direction consistent with a feed direction of the web material, at least one motorized shaft on which said at least one first return roller is idly mounted.

10. An apparatus for the production of sanitary articles, having at least one feeding path of at least one web material carried by at least one reel, wherein the apparatus comprises at least one unwinder for web material according to claim 1.

* * * * *